US012066264B2

(12) United States Patent
Speichinger

(10) Patent No.: US 12,066,264 B2
(45) Date of Patent: Aug. 20, 2024

(54) BARREL AND EXCHANGE SYSTEM FOR A HANDGUN, METHOD FOR OPERATING A HANDGUN, AND CARRIER SLEEVE FOR A BARREL AND/OR EXCHANGE SYSTEM FOR A HANDGUN

(71) Applicant: SCHMEISSER GmbH, Krefeld (DE)

(72) Inventor: Andreas Speichinger, Möhnesee (DE)

(73) Assignee: SCHMEISSER GmbH, Krefeld (DE)

( * ) Notice: Subject to any disclaimer, the term of this patent is extended or adjusted under 35 U.S.C. 154(b) by 46 days.

(21) Appl. No.: 17/383,028

(22) Filed: Jul. 22, 2021

(65) Prior Publication Data

US 2022/0099400 A1 Mar. 31, 2022

Related U.S. Application Data

(63) Continuation of application No. PCT/EP2020/000025, filed on Jan. 23, 2020.

(30) Foreign Application Priority Data

Jan. 23, 2019 (DE) ..... 10 2019 000 416.7

(51) Int. Cl.
*F41A 21/12* (2006.01)
*F41A 21/10* (2006.01)

(52) U.S. Cl.
CPC ..... *F41A 21/12* (2013.01); *F41A 21/10* (2013.01)

(58) Field of Classification Search
CPC ..... F41A 21/04; F41A 21/10; F41A 21/12; F41A 21/16; F42B 8/10
See application file for complete search history.

(56) References Cited

U.S. PATENT DOCUMENTS 1,760,731 A * 5/1930 Williams ..... F42B 8/10 42/76.01
2,090,657 A * 8/1937 Williams ..... F41A 21/12 89/196

(Continued)

FOREIGN PATENT DOCUMENTS

AT 396035 B * 3/1993 ..... F41A 21/10
AU 471965 5/1976

(Continued)

OTHER PUBLICATIONS

International Search Report and Written Decision from the International Research Authority dated May 26, 2020 for International Application No. PCT/EP2020/000025 (16 pages).

*Primary Examiner* — Gabriel J. Klein
(74) *Attorney, Agent, or Firm* — Taylor IP, P.C.

(57) ABSTRACT

A barrel for a handgun includes an imaginary barrel bore axis along which it extends in the x-direction, around which barrel axis the following are formed in the interior of the barrel, in succession from a rear end to a front end: a cartridge chamber, which has a first diameter; a cartridge chamber opening, which has a second diameter; a conical transition, which transitions from the second diameter to a third diameter, which is associated with the guide region; and a barrel opening, an end face being formed around the cartridge chamber opening, and the barrel being suitable for a bullet driven by hot gases to accelerate therethrough. The end face is at least 1.5 times larger than the cross-sectional surface formed by the third diameter.

2 Claims, 8 Drawing Sheets

(56) References Cited

U.S. PATENT DOCUMENTS 2,107,034 A * 2/1938 Guthrie ..... F42B 8/10 102/446
2,196,136 A * 4/1940 Wood ..... F42B 8/10 102/446
2,872,850 A * 2/1959 Davenport ..... F41A 21/10 89/196
3,235,996 A * 2/1966 Maillard ..... F41A 21/12 42/76.01
3,724,326 A * 4/1973 Day ..... F41A 21/10 89/196
3,858,342 A * 1/1975 Langsford ..... F41A 21/12 42/16
3,943,821 A * 3/1976 Seifried ..... F41A 21/12 89/16
4,430,940 A * 2/1984 Jermunson ..... F42B 8/10 102/446
4,702,170 A 10/1987 Trudeau
4,955,157 A * 9/1990 Brighton ..... F41A 11/02 102/446
5,479,737 A * 1/1996 Osborne ..... F41A 21/12 89/14.05
6,276,252 B1 * 8/2001 Dionne ..... F41A 3/86 89/14.05
11,306,989 B2 * 4/2022 Peterson ..... F41A 21/12
2005/0028421 A1 * 2/2005 Saxby ..... F41A 21/10 42/77
2006/0162606 A1 * 7/2006 Meyer ..... F41A 21/10 102/521
2021/0041199 A1 * 2/2021 Mehta ..... F41A 21/04
2021/0048264 A1 * 2/2021 Peterson ..... F41A 21/12

FOREIGN PATENT DOCUMENTS

CH 55968 10/1912
CH 600284 A5 * 6/1978
DE 1203161 B * 10/1965
GB 191127841 A * 1/1912

* cited by examiner

44
Rz1
23
30"
41
Rz2
30'
39
12'
42
43
24-2
41
30

BARREL AND EXCHANGE SYSTEM FOR A HANDGUN, METHOD FOR OPERATING A HANDGUN, AND CARRIER SLEEVE FOR A BARREL AND/OR EXCHANGE SYSTEM FOR A HANDGUN

CROSS REFERENCE TO RELATED APPLICATIONS

This is a continuation of PCT application No. PCT/EP2020/000025, entitled "BARREL AND EXCHANGE SYSTEM FOR A PORTABLE FIREARM, METHOD FOR OPERATING A PORTABLE FIREARM, CARRIER SLEEVE FOR A BARREL AND/OR EXCHANGE SYSTEM FOR A PORTABLE FIREARMT", filed Jan. 23, 2020, which is incorporated herein by reference.

BACKGROUND OF THE INVENTION

1. Field of the Invention

The present invention relates to firearms, and, more particularly, to handguns.

2. Description of the Related Art

The present invention relates to a barrel for a handgun which extends along an imaginary barrel bore axis, extending in the x-direction, around which barrel axis the following are formed in the interior of the barrel, in succession from a rear end to a front end: a cartridge chamber, which has a first diameter; a cartridge chamber opening, which has a second diameter; a conical transition region, which transitions from the second diameter to a third diameter, which is associated with the guide region; and a barrel opening, an end face being formed around the cartridge chamber opening, and the barrel being suitable for a bullet driven by hot gases to accelerate therethrough.

The present invention moreover relates to an exchange system for a hand gun, including a barrel for a hand gun which extends along an imaginary axis, extending in the x-direction, around which barrel axis the following are formed in the interior of the barrel, in succession from a rear end to a front end: a cartridge chamber, which has a first diameter; a cartridge chamber opening, which has a second diameter; a conical transition region, which transitions from the second diameter to a third diameter, which is associated with the guide region; and a barrel opening, an end face being formed around the cartridge chamber opening, and the barrel being suitable for a bullet driven by hot gases to accelerate therethrough, and also including a carrier sleeve to accommodate a cartridge, wherein the carrier sleeve has a sleeve opening end face.

The present invention also relates to a method to operate a handgun.

The present invention further relates to a carrier sleeve for a barrel for a handgun, wherein the carrier sleeve is adapted in its external geometry to a cartridge chamber of the barrel in such a way that the carrier sleeve can be repeatedly inserted from a rear end of the barrel into the cartridge chamber of the barrel and removed again in the opposite direction and, for this purpose, forms at least a first diameter, wherein the carrier sleeve is suitable to receive a cartridge and for this purpose has in its interior at least one inner region forming a third diameter through which a bullet of the cartridge can be guided, wherein the carrier sleeve has a sleeve opening end face.

Handguns have been manufactured for over 500 years and are divided into official and civilian weapons, as well as defensive, hunting and sporting weapons. Even if the transitions are sometimes fluid, the training required for the shooter to increase his accuracy is quite extensive. The cost of ammunition has the greatest influence on training related costs.

Ammunition for modern handgun models is generally designed for a standard cartridge including a shell including at least partially metal. These standard cartridges are respectively designed for a so-called caliber and can be designed as center fire cartridges or rimfire cartridges in accordance with the respective caliber. Furthermore, they have a certain shell volume depending on the caliber, whereby the shell is cylindrical, conical, or bottle-shaped and can have a rim or a belt for support in the cartridge chamber. In contrast, standard cartridges which are designed for use in self-loading weapons usually simply support themselves at the shell opening in the cartridge chamber. While standard cartridges for shotguns (handguns with smooth bore barrels) are usually designed to accept a large number of bullets (so-called shots), standard cartridges for weapons with rifled barrels, regardless of whether the weapon is a short gun (total length less than 60 cm) or a long gun (total length exceeds 60 cm), are usually designed to accept a single bullet. The caliber of the standard cartridge is designated more or less exactly according to the barrel caliber of the weapon for which it is suitable. In most cases, the designation includes additional information such as the shell length, addition of a name, the year of development or introduction, or, in the case of older designations, the intended propellant charge and/or bullet weight.

Depending on the demands a shooter imposes on his accuracy, or which are imposed on him, for example, through a chain of command, the training requirement increases. This is all the more the case if the shooter has to shoot with a large-caliber weapon, since in addition to the necessary concentration and meeting of physical demands, the shooter must achieve an increased degree of balance in order to be able to deal repeatedly with the recoil resulting from the shot.

As already mentioned, the cost of ammunition has the greatest influence over costs associated with training. These increase, independent of the strength of the cartridge. If the various standard cartridges available on the market are assigned to different categories, the cost of using the most common cartridges on the market is reduced.

In the governmental sector where currently in western European countries, self-loading weapons are predominantly used, cartridges in 9 mm caliber are most widespread. For example in short weapons: 9 mm Luger, 0.40 Smith & Wesson or 0.45 Colt Automatic Pistol.

Already compared to these three extremely popular short weapon calibers, cartridge costs are reduced by approximately 70% to over 90% when a small caliber 0.22 long rifle cartridge is used. For the sake of simplicity, this cartridge will be referred to below as "KK cartridge", whereas cartridges more powerful than the 0.22 long rifle, as well as the above-mentioned short barrel weapon cartridges in the caliber 9 mm Luger, 0.40 Smith & Wesson or 0.45 Colt Automatic Pistol—at least in the sense of the present document—are called large-caliber cartridges or large standard cartridges.

In order to make use of these savings, it is known from the state of the art to offer weapon models of seemingly the same appearance as the respective weapons in the calibers mentioned or in other calibers, which are equipped for the KK cartridge. However, the firing behavior of such a weapon model is normally vastly different from that of its sister model in the stronger caliber. In order to counter this, it is thus known that the cartridge chamber of the barrel can be movably mounted inside a barrel jacket in alignment with the axis of the barrel bore, which significantly increases the recoil acting on the shooter. However, these weapons have a greatly reduced precision and are therefore only suitable for basic training. In addition, the moving chamber gets dirty very quickly due to the powder residue and abraded particles produced by each shot, which reduces its function. In any case, the disadvantage of a training weapon specifically designed for the KK cartridge is that a complete second handgun must be purchased.

In order to reduce purchasing costs, but also to provide the shooter with the option to train by using cost-effective KK cartridges under otherwise unchanged conditions, exchange systems for self-loading pistols are known from the state of the art in a large number of designs. Such exchange systems generally include a breech, a barrel, a locking spring, in most cases also an individual locking spring pin as well as a magazine specifically designed for the KK cartridge.

A disadvantage is herein, that exchange systems that are designed for KK cartridges most times feature a breech consisting of a light metal in order to ensure safe self-loading properties considering the low power of the KK cartridge. In addition, in particular due to the second locking spring there is the possibility of mix-ups and the associated risk of malfunction or even potential injury. If the breech is not carefully fitted to the grip of the self-loading pistol, losses in precision must be accepted. If, on the other hand, the breech of the exchange system is fitted by a specialist, the cost advantage compared to a separate KK weapon is reduced. If the exchange system is equipped with a cartridge chamber that can be moved in alignment with the axis of the barrel bore, the same advantages and disadvantages arise as with the self-loading pistols already described.

Based on this background, what is needed in the art is a barrel and/or an exchange system for a handgun, in particular a self-loading pistol, which is designed for a small caliber cartridge, and which is inexpensive to acquire, and in particular minimizes possible risks of mix-ups and injury, has a precision potential that is as high as possible and is suitable for making possible the adjustment of a recoil of the handgun corresponding to a more powerful cartridge.

SUMMARY OF THE INVENTION

The present invention provides a barrel of the type discussed at the beginning, wherein the front face (which can be referred to as an end face) is at least 1.5 times larger than the cross-sectional surface formed by the third diameter.

Due to the resulting relationship of the front face to the cross-sectional surface formed by the third diameter, the barrel is able to hold the pressure generated when firing a cartridge for a relatively long time in the region of the cartridge chamber and to direct a high proportion of the pressure force in the direction of the rear end.

Since the chamber of a handgun or respectively, the chamber of a barrel for a handgun has to withstand the highest gas pressure during firing, one usually wants to achieve a rapid reduction of the effective gas pressure.

Since the gas pressure acting in the direction of the rear end of the barrel acts against a component of the handgun, more precisely against the butt plate of the breech of the handgun, it is normally desirable to keep the gas pressure component acting in the direction of the rear end particularly low.

The present invention departs from these two principles prevailing in the construction of handguns, since it has been recognized in accordance with the present invention that a barrel constructed in accordance with the properties described above in this section makes locking of KK cartridges in an otherwise unmodified handgun possible, in particular in a self-loading weapon, especially particularly in a self-loading pistol which is (otherwise) set up for a large-caliber cartridge, without having to make further adjustments to the handgun. In particular, no additional parts need to be exchanged, so that the risk of mix-ups with other parts that may appear to the user to be the same or similar does not even exist. In addition, there are no costs for other necessary replacement parts of the handgun, especially not for a special extractor for a special locking head, and/or a complete, separate breech, special magnets, a locking spring with separate tuning, or other change parts. Due to the fact that only one single component of the handgun has to be changed to use KK cartridges, precision reducing influences compared with the respective standard of the corresponding handgun remain low. Due to the high proportion of pressure deflected at the end faces in the direction of the rear end and due to the relatively long effective time of the pressure resulting from the already described surface ratio, the handgun having its dimensions (mass, weights, forces) and components adapted to the use of a large-caliber cartridge can be operated with a high degree of functional reliability by a KK cartridge.

Although it is obvious, it is pointed out once again that a barrel, in the sense of the current document, is to be understood to be a barrel for a handgun which is suitable of a bullet being inserted into the barrel from its rear end in a standard cartridge and during the shot being completely accelerated through same by said bullet that is propelled by hot gases when fired, until it leaves the opening.

It is thereby possible that the end face be at least 2.00 times, or at least 2.15 times, or at least 2.35 times, larger than the cross sectional surface formed by the third diameter.

In this way, even better functional reliability can be achieved during operation. In addition, the independence from individual, different experimental versions of the usable KK cartridges available on the market from various suppliers is improved, which can again contribute to cost reductions in operation.

The barrel can be designed to accommodate carrier sleeves, which in turn can be designed to accept KK cartridges. The external shape of the carrier sleeves can therein be adapted to the external shape of a large-caliber cartridge.

It can be that the cartridge chamber opening is designed in a plane which is substantially normal to the barrel bore axis and that the end face extends at least in part in the plane.

This achieves an especially effective deflection of the gas pressure in direction of the rear end of the barrel.

It can be advantageous if the end face runs in a funnel shape towards the cartridge chamber opening.

This provides additional stability to the barrel.

In other cases it may be advantageous if the end face is formed at least in part beyond the plane into the surrounding region, concentrically arranged around the transition region.

This leads to an additional prolongation of the phase in which the gas pressure present in the cartridge chamber during firing is above a certain threshold. Depending on the breech system of the handgun model for which the barrel is intended, both the functional safety and the recoil behavior experienced by the shooter can thereby be influenced.

It can be of great advantage if the end face has a channel-shaped recess, running in a ring-shaped arrangement around the cartridge chamber opening.

A gas pressure cushion is formed in the recess so that the phase in which the gas pressure present in the cartridge chamber during firing is above a certain threshold is extended without the maximum value of the acting gas pressure having to be increased.

It is of particular advantage if the plane in which the cartridge chamber opening is positioned is arranged at a distance from the rear end which is disproportionate to the other cartridge chamber dimensions adapted to a specific cartridge caliber.

The distance between the plane in which the cartridge chamber opening is positioned and the rear end of the barrel can be either smaller or larger than the permissible cartridge length of the cartridge for which the corresponding handgun is equipped.

This can prevent potential accidents due to erroneous loading of a large caliber cartridge into the barrel.

The barrel can have an outside contour with a barrel top side and a barrel bottom side, and the axis of the barrel bore can be eccentrically placed relative toward the bottom side of the barrel.

Due to this it is possible to forego a modification in the ignition mechanism of the handgun, even if the handgun is designed for a large caliber cartridge which is in the embodiment of a so-called centerfire cartridge, and the KK cartridge is a rimfire cartridge. In addition it is assured, that a possibly erroneously loaded large caliber centerfire cartridge cannot be fired due to its eccentric position. This represents an important safety aspect.

On the bottom side of the barrel, a barrel ramp with a guide surface for a bullet and/or a shell of a cartridge can be arranged.

A barrel ramp with a guide surface greatly supports the functional safety of a handgun, in particular when the handgun is a self-loading weapon, in particular a self-loading pistol.

In addition, an important prerequisite is provided for careful insertion of cartridges—or respectively carrier sleeves accommodating cartridges—into the interior of the barrel, in particular into the cartridge chamber, whereby also the risk of precision losses due to damaged cartridges is reduced.

It is thereby possible that the guide surface of the barrel ramp includes a first part and a second part and that the second part is arranged on the barrel or is firmly connected with the barrel and that the first part is arranged on a ramp block which is detachable from the barrel, which can be without tools.

A ramp block which is detachable from the barrel, and which includes the first part of the guide surface offers several advantages. For example, the design of the guide surface can easily be adapted to special requirements. Since a ramp block can be produced very cost effectively, various ramp blocks can then be made available for one barrel and can be interchangeable among each other.

Moreover, provision of a barrel with a detachable ramp block considerably simplifies disassembly and subsequent reassembly of the handgun for cleaning purposes. This applies in particular, if the ramp block is designed for tool-free, detachable securement in the handgun.

The ramp block can be clamped into the handgun and have at least a first functional surface and a second functional surface.

On the one hand, the functional surfaces can serve fastening—on the other hand also alignment with repeated accuracy—of the ramp block in the handgun, which adds to the functional safety and precision in operation. In addition, especially comfortable handling of the handgun is possible, for example when said weapon is to be cleaned.

A first gliding surface can be provided on the bottom side of the barrel and a second gliding surface is provided on the top side of the ramp block, so that on contact between the first gliding surface and the second gliding surface the barrel is movable along the two gliding surfaces, parallel to the axis of the barrel bore.

In this manner the functional safety of the handgun during use is again supported by this barrel arrangement because excess forces—perhaps when using experimental KK cartridges—are easily dampened by relative movement, so that a self-regulating damping system is provided.

The present invention in another form is directed to an exchange system of the type described at the beginning in that, the end face as well as the sleeve opening end face in their own right respectively, are each at least 1.5 times larger than the cross sectional surface formed by the third diameter.

In connection with the claimed exchange system for a handgun, the described advantages for the respective handgun or respectively for operation of a respective handgun are especially feasible, based on the use of a barrel according to the invention, if also the sleeve opening end face of the carrier sleeve associated with the exchange system in its own right is at least 1.5 times larger than the cross sectional surface of the barrel that is formed by the third diameter.

The exchange system can include a barrel according to what is described above.

The relevant advantages are easily understood by the expert from the previously described advantages in connection with the barrel and will not be repeated in this instance for economic reasons.

The present invention in yet another form is directed to a method for operating a handgun, wherein a barrel or an exchange system according to what is described above is used for operating a handgun.

The method can be applied by using a handgun which includes at least the following:

- a grip
- a breech arranged movably on the grip
- a locking spring
- a locking unit
- an original barrel with a cartridge chamber to accommodate a large caliber standard cartridge, and wherein the barrel and the locking spring, depending on the position of the locking unit, can be detached from the grip, and attached to the grip, together as an assembly group, and that the following process steps are implemented:

- detaching the assembly group including breech, locking spring and original barrel from the grip
- exchange of original barrel with a barrel according to what is described above
- reinsertion of the locking spring
- insertion of the ramp block into the grip of the handgun
- fastening of the assembly group including breech, locking spring and barrel onto the grip of the handgun
- insertion of a magazine containing carrier sleeve with cartridges therein into the handgun.

The sequence of the specified process steps can also be changed and/or supplemented in a meaningful manner.

The advantages of the method according to the present invention for operating of a handgun are also easily understood by the expert from the previously described advantages in connection with the barrel and will not be repeated in this instance for economic reasons.

In the case of a carrier sleeve of the type referred to at the beginning, the present invention provides that the sleeve opening end face in its own right is at least 1.5 times larger than the cross sectional surface that is formed by the third diameter.

The sleeve opening end face can extend from an opening of the carrier sleeve to a cylindrical part of a surface area of the carrier sleeve. The cylindrical part of the surface area is therein characterized by a first diameter of the carrier sleeve. The end face herein can be divided into a first end face and a second end face.

Due to the fact that the third diameter in the interior of the carrier sleeve must be larger than the third diameter characterizing the barrel, the sleeve opening end face is naturally also at least 1.5 times larger than the cross sectional surface that is formed by the third diameter of the barrel.

This relationship must be such that the bullet must be slightly compressed inside the barrel to ensure guidance through the guide profile provided inside the barrel (which, in the case of a smooth barrel, is simply provided by the inner wall of the barrel and, in the case of a rifled barrel, by the field-tension profile or, in the case of a polygonal barrel, by the polygonal shape introduced inside).

The third diameter of the carrier sleeve can correspond also to the diameter of the opening of the carrier sleeve.

As already outlined in connection with the exchange barrel and the method for operating a handgun, the advantages of the carrier sleeve are also easily understood by the expert from the previously described advantages in connection with the barrel and will also not be repeated in this instance for economic reasons.

With a carrier sleeve of this type it is moreover advantageous if the carrier sleeve includes a zinc alloy which has a zinc component of at least 55%, in particular at least 70%, more particularly at least 80%.

Due to its known brittleness, zinc is hardly suitable for a pressure chamber and, according to general understanding is therefore omitted from fulfilling the technical tasks that are the basis of the carrier sleeve. Since, however, the sleeve opening end face in its own right, is at least 1.5 times larger than the cross sectional surface formed by the third diameter, the regions stabilizing the cartridge, in particular the small caliber cartridge, are under a counter pressure, which attacks angularly, but can stabilize sufficiently in order to ensure proper function of the carrier sleeve or respectively of an exchange system with carrier sleeve, thus enabling smooth operation of a handgun.

Since zinc alloys are suitable for producing precise pressure casting components with narrow tolerances in a price effective manner, these advantages can be used especially advantageously if the carrier sleeve does not only contain a zinc alloy, but in particular consists of a zinc alloy.

In an alternative to the aforementioned embodiment it may however be optional, that the carrier sleeve consists at least partially of a plastic material, in particular a reinforced or unreinforced plastic from the group of polyamides (PA), polyoxymethylene (POM) or polyaryletherketone, in particular polyetheretherkatone (PEEK).

In this manner a carrier sleeve can also be produced especially price effectively. This offers the advantage that the shooter, when purchasing carrier sleeves is not limited to a smaller quantity. If the shooter has many carrier sleeves available to him for a training session, he can train especially efficiently. In governmental training sessions, quick exchange of empty magazines can for example also be practiced.

In providing carrier sleeves which consist at least partially of plastic, a carrier sleeve is optional which consists of two different materials, especially of copper and for example a metal such as brass or copper, or a transitional metal, such as zinc.

For the formation of corresponding surfaces, it is optional if the carrier sleeves are manufactured using a so-called hot tool, in particular on a surface area characterized by the first diameter and/or on the inner region of the carrier sleeve that is characterized by the third diameter.

In many cases it can be advantageous if the carrier sleeve has a first average surface roughness depth in at least one section of a surface area of the carrier sleeve, characterized by the first diameter, and a second average surface roughness depth in at least one section of an interior surface area of the carrier sleeve, characterized by the third diameter, and if the first average surface roughness depth is smaller than the second average roughness depth.

The entire surface area of the carrier sleeve which is characterized by the first diameter can have a first average roughness depth, and the entire interior surface area of the carrier sleeve which is characterized by the third diameter can have a second average roughness depth.

In these contexts it can be that the first average roughness depth is in a range of 0.04 μm and 8.0 μm, and that the second average roughness depth compared to the first average roughness depth is increased by at least 10%, or by at least 25%, or by at least 35%, and by a maximum of 250%, or by a maximum of 200%.

This offers the advantage that when firing, the cartridge in the carrier sleeve adheres more strongly to the inner surface of the carrier sleeve, characterized by the third diameter, than the carrier sleeve adheres to the inner wall of the cartridge chamber of the barrel via the surface characterized by the first diameter. This supports a smooth discharge of the carrier sleeves in self-loading weapons and ensures a smooth operation.

Since the (small caliber) cartridges are loaded into the carrier sleeves before the actual training, the increased frictional resistance is of secondary importance.

It can also be greatly advantageous if the carrier sleeve in its interior has an expansion area featuring a fourth diameter in which the shell of the cartridge during the shot can expand at least in a partial section in a way, that it is plastically deformed after the shot.

In this way, a good connection between the cartridge casing remaining in the carrier sleeve and the carrier sleeve is achieved by the firing of the cartridge stored in the (small caliber) carrier sleeve, thereby enabling a low-loss pulse transmission, which is especially conducive for a smooth operation of the handgun. In particular, especially favorable conditions are hereby created for utilization of a locking spring intended for a standard cartridge of the handgun.

In sum, the present invention provides a barrel for a handgun, an exchange system for a handgun, as well as to a method to operate a handgun, and a carrier sleeve.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
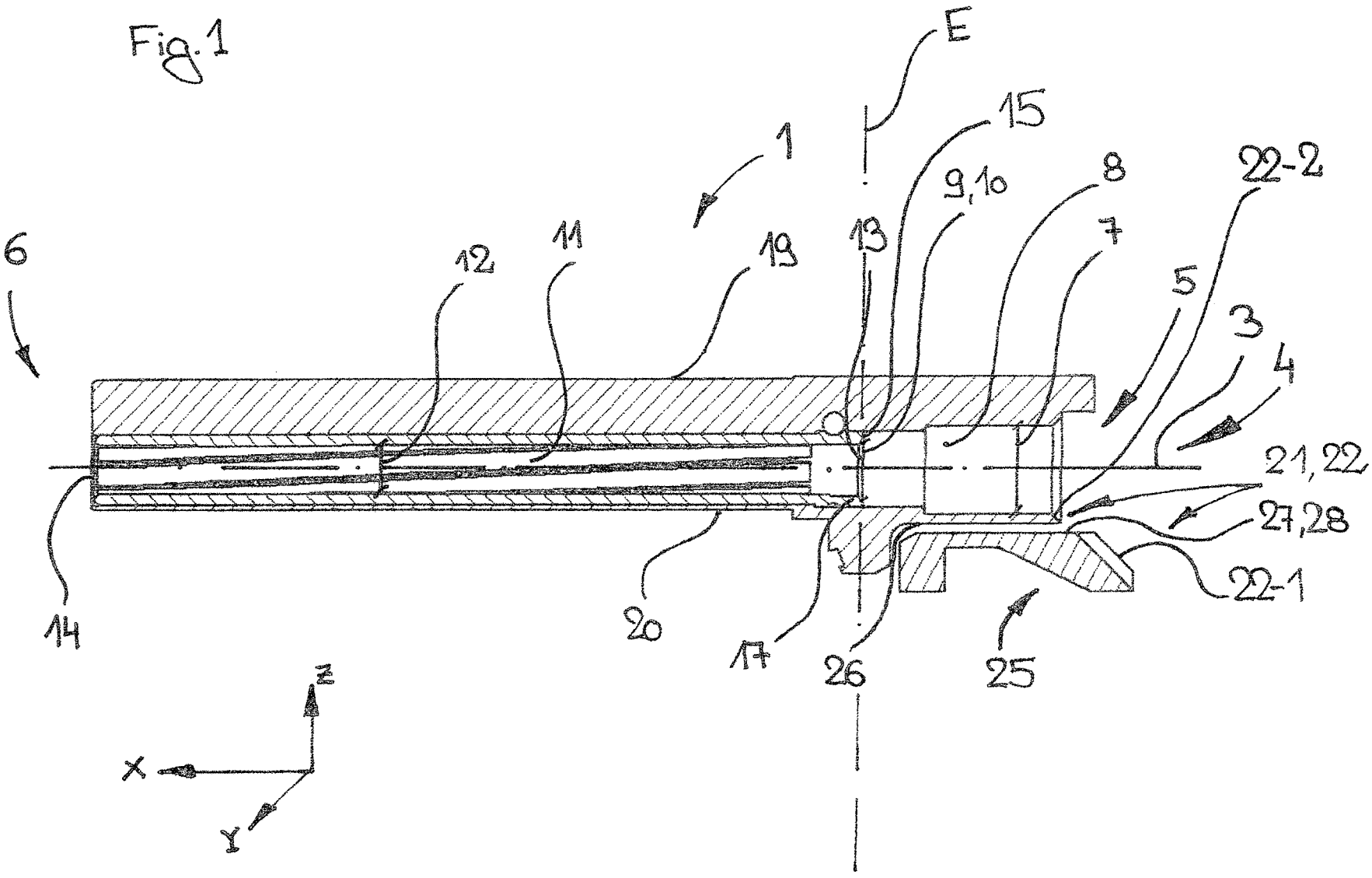
FIG. 1 is a sectional side view of a barrel for a handgun.

Referring now to the drawings, and more particularly to FIG. 1, there is shown a barrel 1 for a handgun 2 which extends along an imaginary barrel bore axis 3, extending in the x-direction, around which the following are formed in interior 4 of barrel 1, in succession from a rear end 5 to a front end 6: a cartridge chamber 8, which has a first diameter 7; a cartridge chamber opening 10, which has a second diameter 9; a conical transition region 13, which transitions from second diameter 2 to a third diameter 12, which is associated with guide region 11; and a barrel opening 14, an end face 15 being formed around cartridge chamber opening 10, and wherein barrel 1 is suitable for a bullet 16 driven by hot gases to accelerate therethrough, wherein end face 15 is at least 1.5 times larger than the cross-sectional surface formed by third diameter 12. In the illustrated example, the end face is intended to be approximately 2.42 times larger than the cross sectional surface formed by third diameter 12. In the illustrated example, third diameter 12 of guide region 11 is adapted to the diameter of the bullet of a so-called small caliber cartridge, more precisely the standard cartridge caliber 0.22 long rifle.

Cartridge chamber opening 10 is arranged in a plane E which is substantially normal to barrel bore axis 3 and end face 15 extends at least in part in plane E. In some regions, end face 15 runs in a funnel shape towards cartridge chamber opening 10.

Figure 2A:
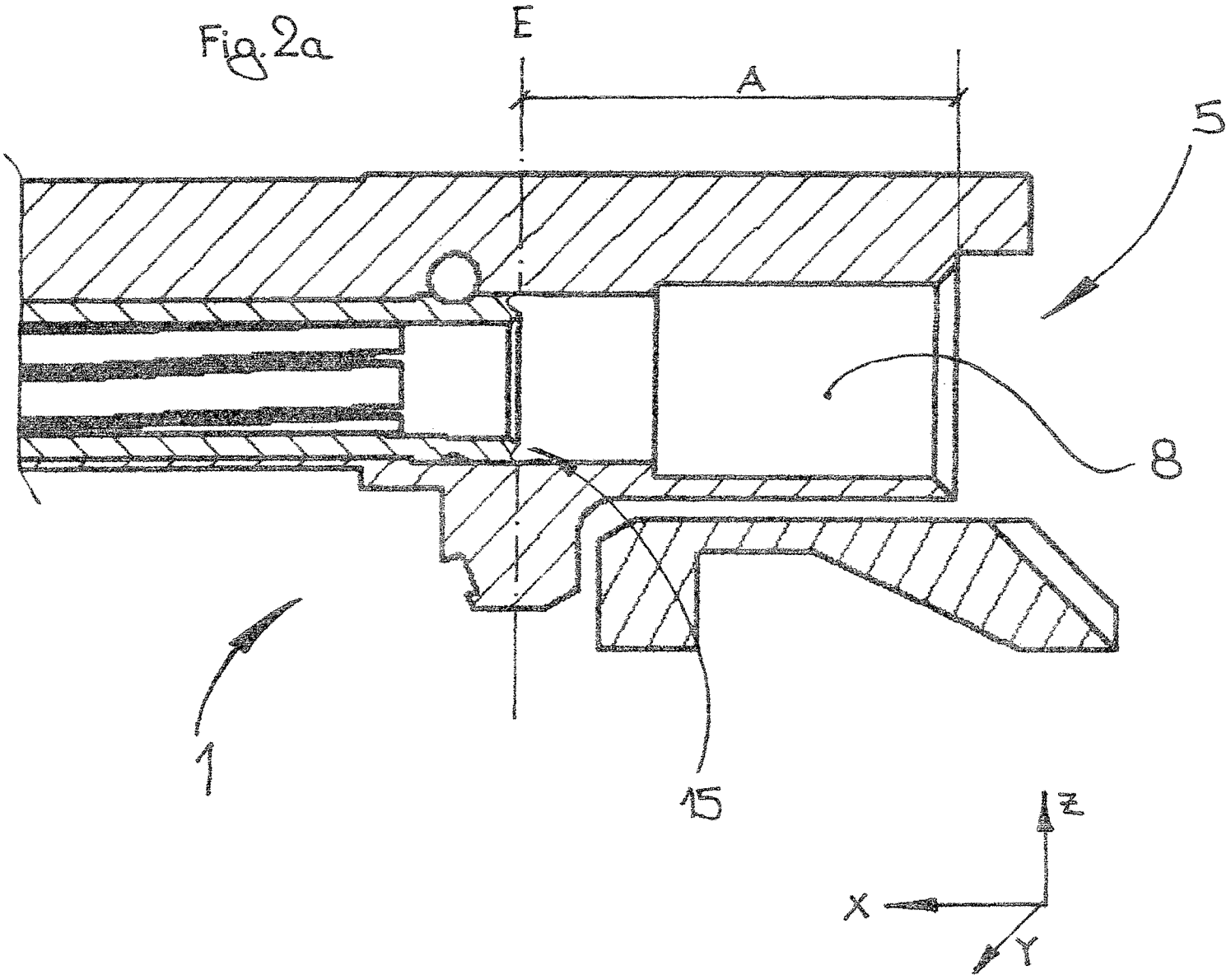
FIG. 2*a* is a detailed view of an alternative arrangement in the end face design.

FIG. 2*a* shows an alternative arrangement of the design of end face 15. In this version, end face 15 extends at least in part beyond plane E into surrounding region 17, concentrically arranged around transition region 13.

Figure 2B:
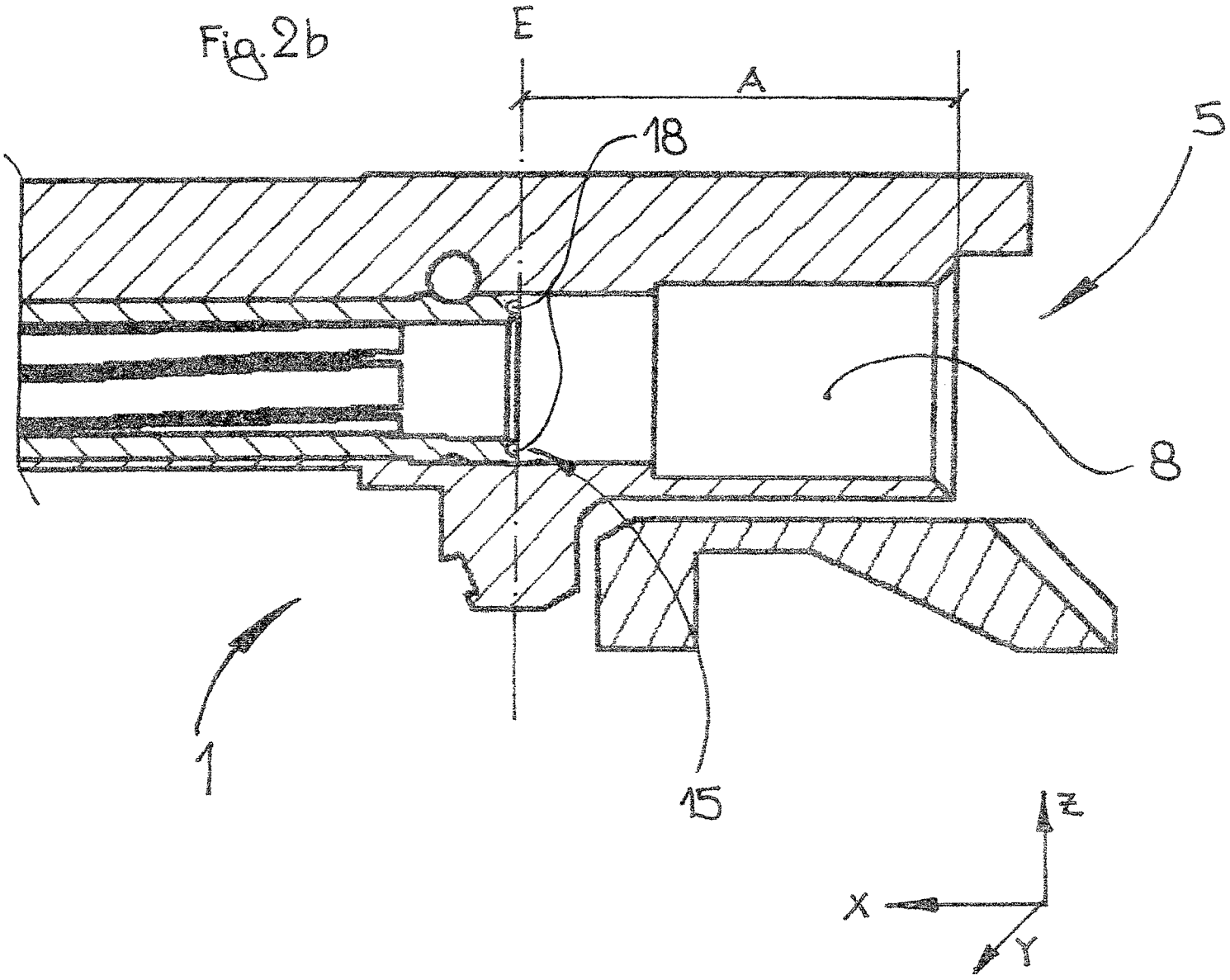
FIG. 2*b* is a detailed view of an alternative arrangement in the end face design.

FIG. 2*b* illustrates an additional alternative arrangement of the design of end face 15. In this arrangement, end face 15 has a channel-shaped recess 18, which can run in a ring shaped manner around cartridge chamber opening 10. This design characteristic can be combined with the two alternatives described previously.

In FIGS. 2*a* and 2*b*, distance A of end face 15 to rear end 5 of the barrel is also recognizable. Consistent in all subsequent drawings, the reference identifications used in previously discussed drawings are used accordingly for same components.

FIG. 1 also shows that barrel 1 has an outside contour with a barrel top side 19 and a barrel bottom side 20 and that the axis of barrel bore 3 is eccentrically placed relative toward bottom side 20 of the barrel. In addition a barrel ramp 21 with a guide surface 22 for a bullet and/or a shell 23 of a cartridge 24 is arranged on bottom side 20 of the barrel. Bullet 16 and/or shell 23 of a cartridge 24, or in particular a carrier sleeve 29, is supported and guided on the guide surface when it is inserted, for example in the self-loading process, by breech 32 or a component associated with same, for example a breechblock head, from the magazine of a handgun 2 which is not shown here but merely indicated in FIG. 5, into cartridge chamber 8 of barrel 1 from its rear end 5.

It is herein recognizable, that guide surface 22 of barrel ramp 21 includes a first part 22-1 and a second part 22-2 and that second part 22-2 is arranged on barrel 1 or is firmly connected with barrel 1, and that first part 22-1 is arranged on a ramp block 25 which is detachable from the barrel, which can be without tools. First part 22-1 represents more than 50%, even more than 75% of the guide surface.

A first gliding surface 26 is provided on bottom side 20 of the barrel and a second gliding surface 28 is provided on top side 27 of ramp block 25, so that on contact between first gliding surface 26 and second gliding surface 28, barrel 1 is movable along the two gliding surfaces 26, 28, parallel to the axis of barrel bore 3.

Figure 3:
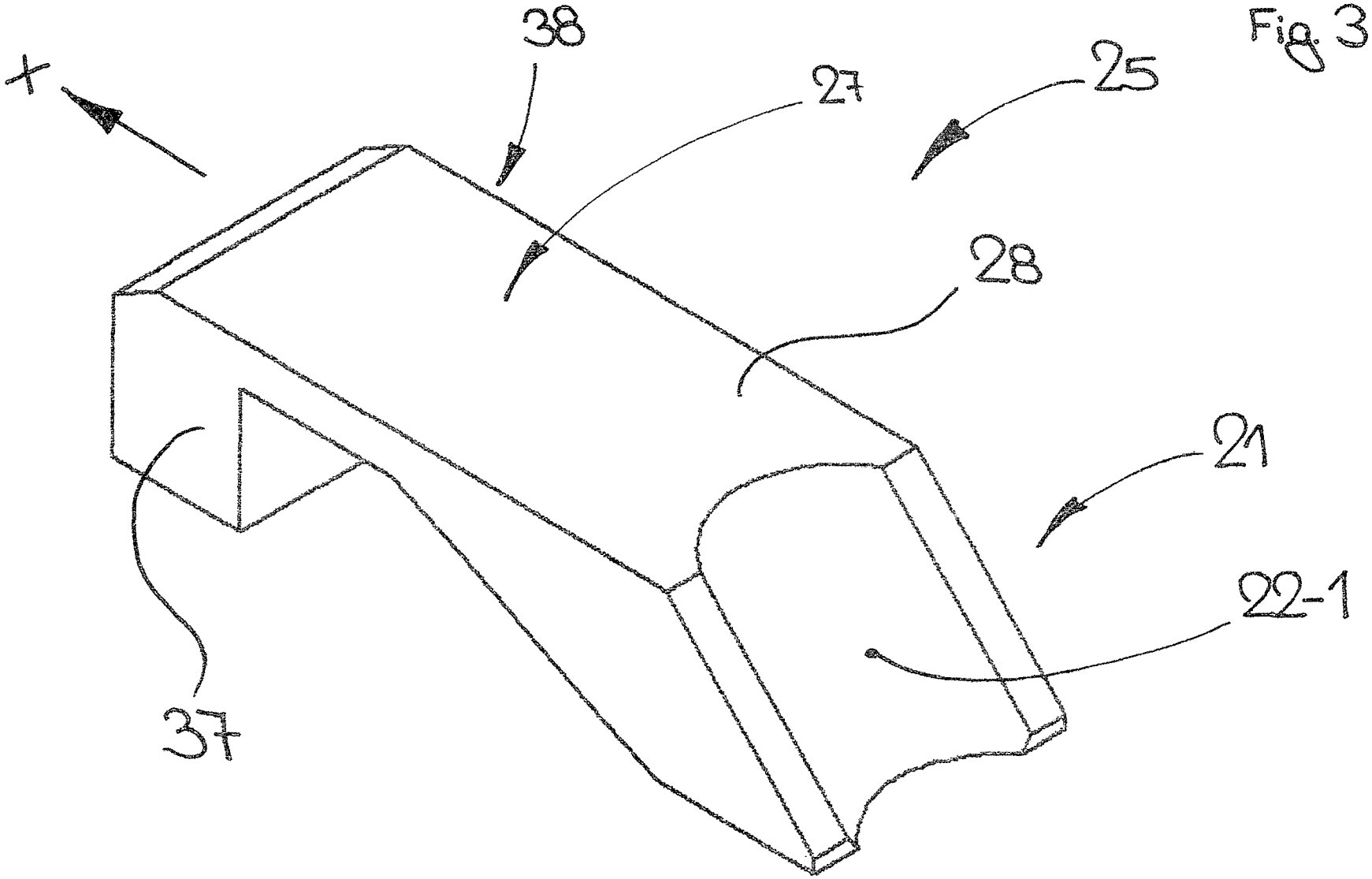
FIG. 3 is a ramp block associated with and separable from the barrel, shown in a spatial representation.

FIG. 3 shows the ramp block in a perspective view. Ramp block 25 is designed for tool-free detachable securement in handgun 2 which is merely indicated in FIG. 5 and has a first functional surface 37 and a second functional surface 38.

Figure 4:
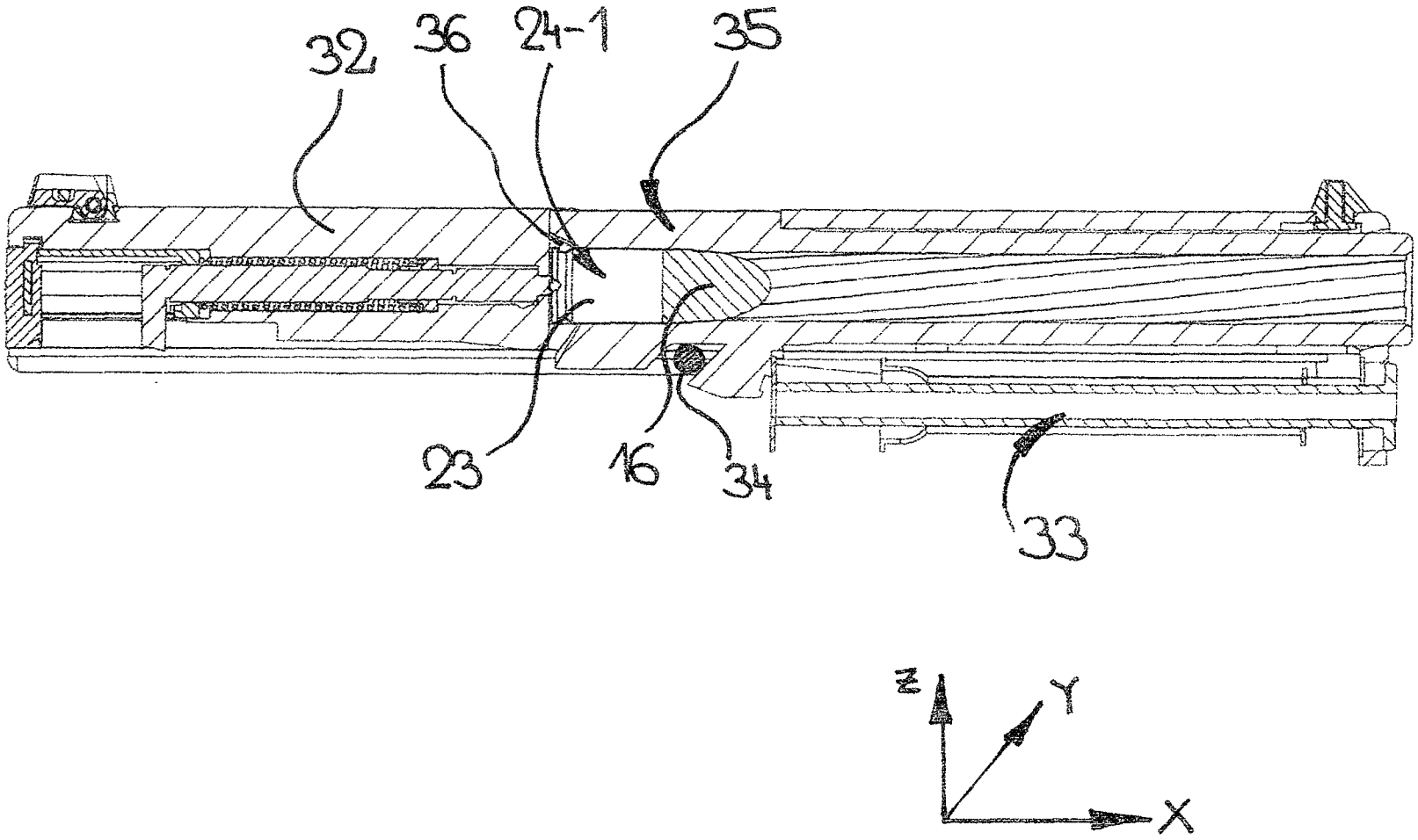
FIG. 4 is an assembly group including original breech, original barrel, and original locking spring of a handgun with a large caliber cartridge in the cartridge chamber.
Figure 5:
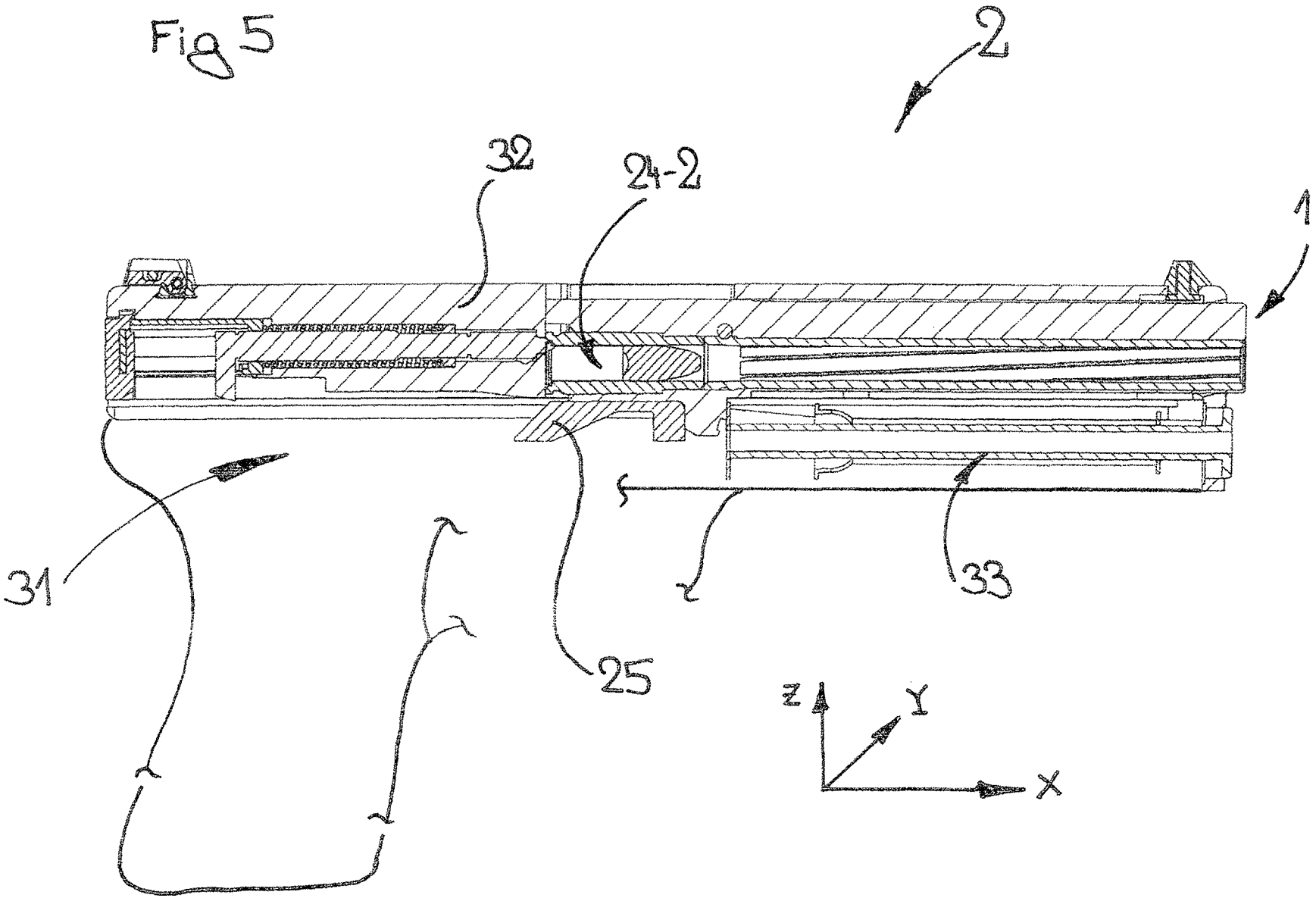
FIG. 5 is an assembly group including original breech, barrel and original locking spring of a handgun with a carrier sleeve in the cartridge chamber and a small caliber cartridge stored therein.

FIG. 4 shows an assembly group of a grip component 31 indicated in FIG. 5, consisting of a breech 32, an original barrel 35 and a locking spring 33, which can be released and fixed on grip component 31 in a repeatable manner, depending on the position of locking unit 34. A large caliber cartridge 24-1 is illustrated in the assembly group, for purpose of clarification. FIG. 4 thus shows the condition of a handgun 2—also merely indicated in FIG. 5—before exchange of original barrel 35 and barrel 1, whereas FIG. 5 shows the condition after the exchange of original barrel 35 and barrel 1.

For the sake of clarity, a carrier sleeve 29 is illustrated in cartridge chamber 8 of barrel in FIG. 5 which is loaded in its interior with a KK cartridge. All other components of handgun 2, in particular also breech 32 and locking spring 33 are identical to the components shown in FIG. 4.

Figure 6A:
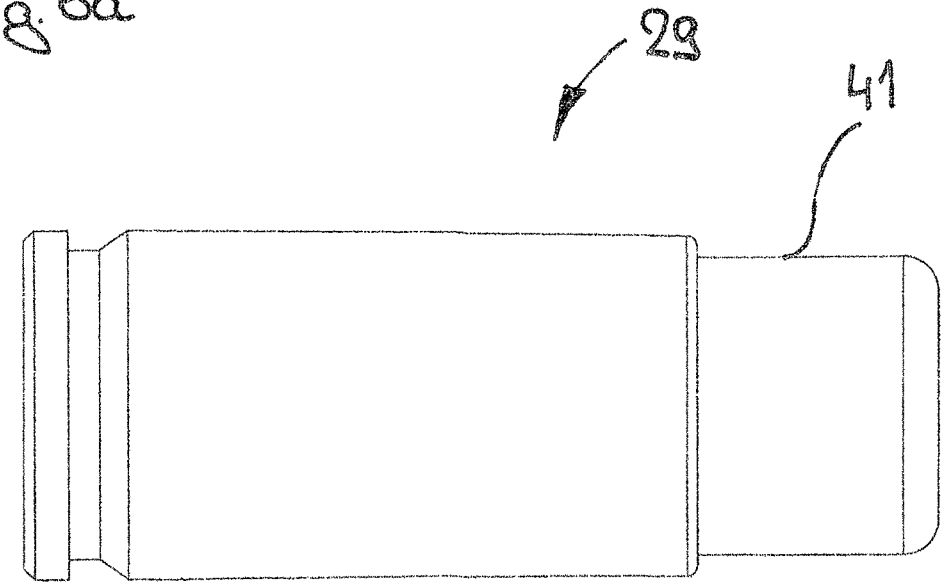
FIG. 6*a* is a side view of carrier sleeve of the exchange system.
Figure 6B:
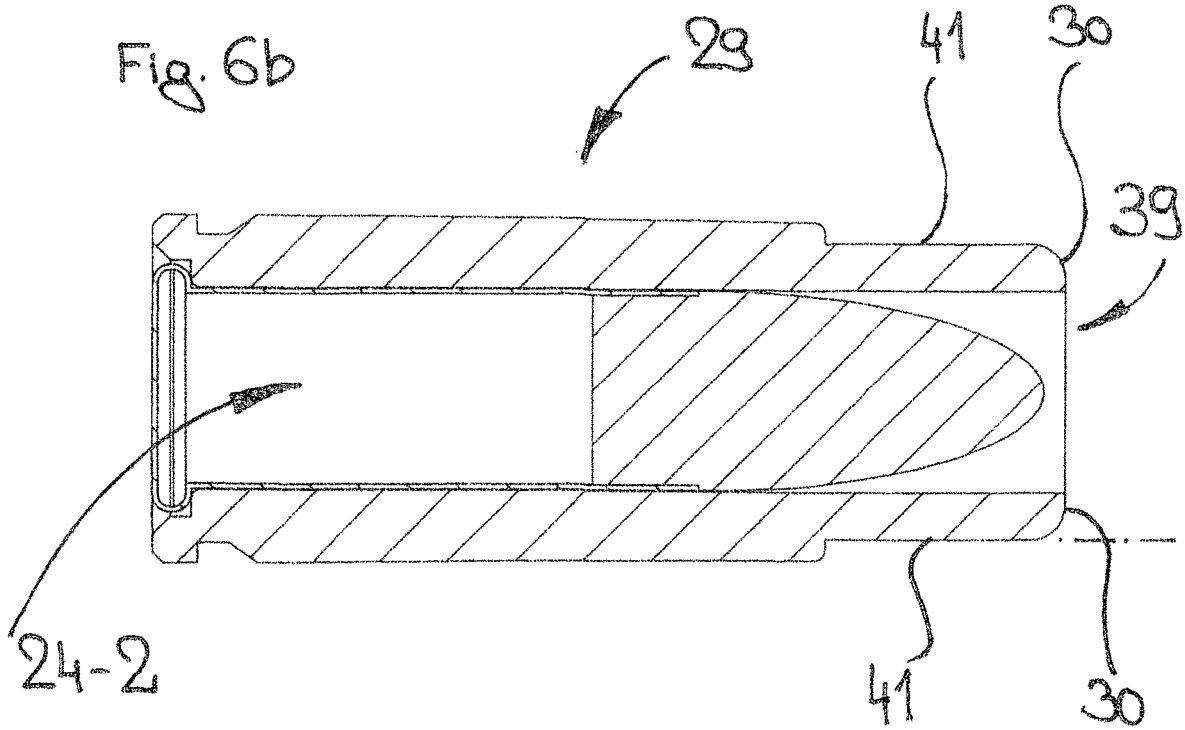
FIG. 6*b* is a side view of carrier sleeve of the exchange system.

FIGS. 6*a* and 6*b* show a carrier sleeve which is shown in a side view in FIG. 6*a* and in a sectional side view in FIG. 6*b*. In the sectional side view, sleeve opening end face 30 is clearly recognizable, extending from opening 39 of carrier sleeve 29 to cylindrical part 40 of its surface area 41. The end face is convex in the illustrated example.

Figure 6C:
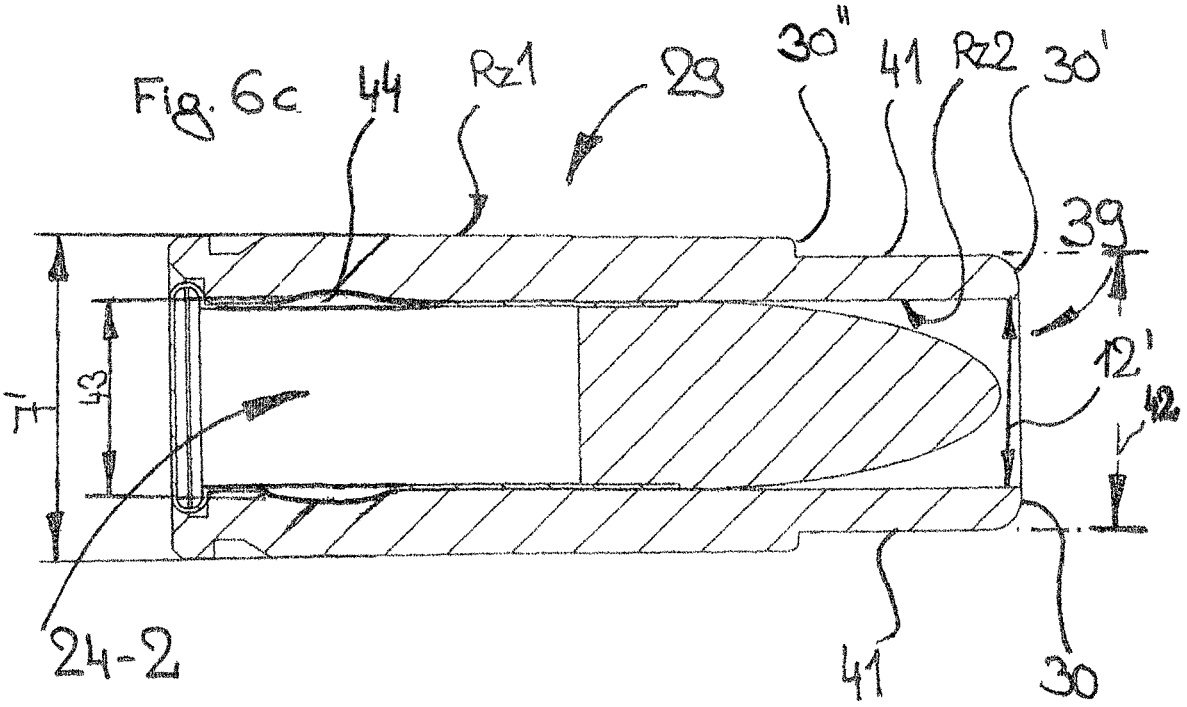
FIG. 6*c* is a side view of carrier sleeve of the exchange system.

FIG. 6*c* shows an arrangement of a carrier sleeve 29 which, in at least one section of a surface area of carrier sleeve 29, characterized by first diameter 7', has a first average surface roughness depth Rz1, and a second average surface roughness depth Rz2 in at least one section of an interior surface area of carrier sleeve 29, characterized by third diameter 12', and wherein first average surface roughness depth Rz1 is smaller than second average roughness depth Rz2. In this case, the entire surface area of carrier sleeve 29 which is characterized by first diameter 7' is identified by a first average roughness depth Rz1, whereas the entire interior surface area of the carrier sleeve which is characterized by third diameter 12' has a second average roughness depth Rz2. First average roughness depth Rz1 is hereby in a range of between 0.04 μm and 8.0 μm, and second average roughness depth Rz2 compared to the first average roughness depth Rz1 can be increased by at least 10%, or by at least 25%, or by at least 35%, and by a maximum of 250%, or by a maximum of 200%. In addition, this arrangement of carrier sleeve 29 has in its interior a fourth diameter 43 which belongs to an expansion region 44 in which the shell of cartridge 24-2 during the shot can expand at least in a partial section in a way, that it is plastically deformed after the shot.

The carrier sleeve can form an area at its front region, which can be qualitatively adapted to the shape of a bullet of a large-caliber cartridge and can form a second diameter 42 there. Front face 30 (which can be referred to as an end face) can then be divided into a first front face 30' and a second front face 30".

Component Identification List

1 barrel
2 handgun
3 barrel bore axis
4 interior of barrel
5 rear end
6 front end
7 First diameter
7' first diameter of carrier sleeve
8 cartridge chamber
9 second diameter
10 cartridge chamber opening
11 guide region
12 third diameter
12' third diameter of the carrier sleeve
13 transition region
14 barrel opening
15 end face
16 bullet
17 surrounding region
18 channel-like recess
19 top side of barrel
20 bottom side of barrel
21 barrel ramp
22 guide surface
22-1 first part of guide surface
22-2 second part of guide surface
23 shell
24 cartridge
24-1 large caliber cartridge
24-2 small caliber cartridge (KK cartridge)
25 ramp block
26 first gliding surface
27 top side of ramp block
28 second gliding surface
29 carrier sleeve
30 sleeve opening end face
30' first end face
30" second end face
31 Grip
32 Breech
33 locking spring
34 locking unit
35 original barrel
36 cartridge chamber of original barrel
37 first functional surface
38 second functional surface
39 opening of carrier sleeve
40 cylindrical part of surface area
41 surface area of carrier sleeve
42 second diameter of the carrier sleeve
43 fourth diameter of the carrier sleeve
44 expansion region
E plane
X x-direction
Y y-direction
Z z-direction While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An exchange system for a handgun, comprising:

a barrel for the handgun, the barrel defining and extending along a barrel bore axis extending in an x-direction, the barrel including:
- a rear end;
- a front end;
- an interior;
- a cartridge chamber, which is formed around the barrel bore axis in the interior and has a first diameter;
- a cartridge chamber opening, which is formed around the barrel bore axis in the interior, succeeds the cartridge chamber in a direction from the rear end to the front end, and has a second diameter;
- a conical transition region, which is formed around the barrel bore axis in the interior and immediately succeeds the cartridge chamber opening in the direction;
- a guide region, which has associated therewith a third diameter, the conical transition region transitioning from the second diameter to the third diameter which is associated with the guide region;
- a barrel opening, which is formed around the barrel bore axis in the interior and succeeds the conical transition region in the direction; and
- an end face formed around the cartridge chamber opening, the barrel being configured for a bullet driven by hot gases to accelerate therethrough, the cartridge chamber opening is designed in a plane which is substantially normal to the barrel bore axis, the end face extending in part in the plane and in part not in the plane, the conical transition region and the end face being connected to and shaped differently relative to one another; and a carrier sleeve configured to accommodate a cartridge, the carrier sleeve including a sleeve opening end face, the end face and the sleeve opening end face each being at least 1.5 times larger than a cross-sectional surface formed by the third diameter, the cartridge chamber being configured for receiving the carrier sleeve carrying the cartridge therein and for the carrier sleeve to be expelled from the cartridge chamber after the bullet is fired by the handgun.

2. The exchange system according to claim 1, wherein the end face is one of at least 2.00 times, at least 2.15 times, and at least 2.35 times larger than the cross-sectional surface formed by the third diameter.

* * * * *